United States Patent [19]

Struben

[11] 4,435,926

[45] Mar. 13, 1984

[54] RIDGE ROOF

[76] Inventor: Francis L. Struben, 3870 Jarrettsville Pike, Jarrettsville, Md. 21062

[21] Appl. No.: 413,712

[22] Filed: Sep. 1, 1982

[51] Int. Cl.[3] ..... E04D 13/00

[52] U.S. Cl. ..... 52/3; 52/22; 52/95

[58] Field of Search ..... 52/22, 17, 3, 66, 90, 52/95; 98/29, 31, 32

[56] References Cited

U.S. PATENT DOCUMENTS

| | | | |
|---|---|---|---|
| 1,861,062 | 5/1932 | Nissen | 52/22 |
| 2,306,537 | 12/1942 | Hamm | 52/3 |
| 2,485,473 | 10/1949 | Bishop | 52/3 |
| 2,628,123 | 2/1953 | Lyon | 52/3 |
| 3,478,474 | 11/1969 | Johansson | 52/90 |
| 3,982,360 | 9/1976 | Newman | 52/22 |

*Primary Examiner*—John E. Murtagh

*Attorney, Agent, or Firm*—Walter G. Finch

[57] ABSTRACT

The invention is an improved structure for a new roof for a travel trailer, mobile home, modular or manufactured homes. The invention also has a specific use for modifying a conventional type mobile home having a curved or arc-like roof configuration. The structure consists of central support components, a pair of central mounting members for roofing panels, a pair of eave mounting members, a plurality of air inlet members, a plurality of ridge outlet members, a plurality of roofing panels, a plurality of valley filler members, a plurality of locking bar members, a ridge cap member, gable closure components, and a plurality of fastening members.

12 Claims, 20 Drawing Figures

RIDGE ROOF

BACKGROUND AND SUMMARY OF THE INVENTION

The invention relates to construction of buildings and in particular to the roofs of buildings. Specifically, it relates to ridge-type roofs. A particular application of the ridge-type roof of the invention is for the modification of mobile-type homes which have roofs having a curved or arc-like configuration.

In describing the invention the application to curved or arc-like configured roofs of mobile homes will be used. However, it is to be understood that the use of the structure of this invention for modification of flat roofs, roofs sloping in one direction, multi-level roofs, low-pitch ridge-type roofs, or other variations of roofs, is within the scope and intent of this invention.

It is also to be understood that it is within the scope and intent of this invention to utilize the structure of this invention to provide an initial or original roof on a building, mobile type homes, as well as for travel trailers and modular or manufactured homes.

The ridge roof of this invention is not only functionally practical for modifying a curved or arc-like roof on a mobile home, but it adds to the esthetic value of the home. It is particularly functional when a new permanent roof is required and its unique design updates the appearance of older homes. In reality, when installed on a mobile home over a curved or arc-like roof, it is an "additional roof" with many advantages, as will be explained hereinafter.

The structure of the invention recognizes and takes heed of the old adage that "when you insulate, remember to ventilate". The ridge roof of this invention allows air to circulate through its unique and novel ventilated roof ridge and soffit system.

Additional insulation can be installed over the old roof of the mobile home such as polystyrene or fibreglass. This additional insulation further enhances the value of a ridge-roof.

The roof structure may be made of various materials, however, aluminum is the preferred material to provide a light-weight, maintenance-free roof. The prior art necessity for painting the roof with short-life roof coatings is eliminated.

As will be described later, the cross sectional configuration of the roofing panels, or "skin" of the roof is rigid-formed. This rigid forming reduces the rumble which is characteristic of trailer and mobile home roofs when the wind blows. The roofing panels are interlocked to form a weather-tight roof that will repel rain, ice, and snow. The double structure, formed by the ridge-roof over the existing roof of a mobile home also insulates against noise. The ridge-roof insulation also eliminates noise from rain and hail.

The improved structure of the ridge-roof of this invention, as described hereinafter, insulates so that the building is warmer in cold weather and cooler in warm or hot weather, thus saving on energy costs.

Uniform air flow is one advantage of the ventilating system of the roof structure of this invention. The ridge vent is at the highest point in the structure and the soffit vents are at the lowest point, thus the system stimulates air flow through the thermal effect to a greater degree than other combination of vents. With this arrangement, if there is little or no wind, appreciable "attic" ventilation can still be attained. None of the prior mobile home roofs makes this effective use of the natural forces. The ridge and soffit combination, as provided in this invention, assures a more rapid and complete change of "attic" air than any other combination of non-powered vents and louvres of the prior art.

In this construction of a typical mobile home with curved or arc-like roof, ventilation in the area between the inside ceiling and exterior roof is not taken into consideration. In newer mobile homes this space contains several inches of insulation to reduce the transmission of outside heat or cold into the interior living space. Although this insulation helps repel extreme heat and cold, it does not stop the roof itself from becoming very hot, or cold due to the lack of ventilation.

Of particular interest is the heat build up on a mobile home roof which causes the cavity containing the insulation to absorb the intense heat. The temperatures within the cavity are often reaching temperatures of 140° to 190° fahrenheit, even when the outside temperature is 80° or 90°. Even with efficient insulation, much of this intense heat penetrates into the living area below.

When the sun sets, the source of the heat disappears, however, the heat trapped in the roof cavity does not significantly dissipate during the night. In periods of hot weather, the heat in the cavity builds up and acts as a "hot plate", not only warming the air in the living area, but radiating heat to the occupants as well, requiring a greatly increased demand for the air conditioner and resulting in higher energy costs. The present invention overcomes these extreme problems, the excessive heat is released from the "attic" space through the unique and novel structure of the vented soffits and ridge vent.

In the present structure the former mobile home roof becomes the "attic" floor and the ventilation of air above that floor.

Another condition exists in winter or cold weather. Mobile homes have all of the conveniences of a site-built home, except that they may be proportionately smaller. However, the use of a washer, dryer, both facilities, cooking, and other similar operations increases the amount of water vapor in the air. As the air warms it is capable of holding more water vapor until it reaches a saturation point. Then the water vapor appears as visible water (condensation). This condensation can, and often does, occur within the walls and ceilings, especially when the warm air inside the home is chilled upon contact with a cold surface, such as the inside of a metal roof (as in the "attic" or a mobile home). The result can be soaked and ineffective insulation. The use of the ridge-roof of the present invention eliminates these problems.

The cross sectional configuration of the roof panels of the present invention also virtually eliminates the noise generated by falling rain and hail damage as the rain or hail strikes the sloping sides of the "valleys" of the roof panels with only a bare minimum of horizontal surface in the valley and at the top of each ridge.

It is, therefore, an object of this invention to provide a roof structure that is of a ridge-type configuration.

It is another object of this invention to provide a roof structure that can be easily mounted over and affixed to an existing roof structure having a curved or arc-like configuration.

It is a further object of this invention to provide a roof structure that has a soffit and ridge ventilating system.

It is still another object of this invention to provide a roof structure that is easily installed.

It is still another object of this invention to provide a structural roof design which can be transported with the mobile home when it has to be moved.

Even another object of this invention is to provide a light weight roof structure which can be transported with the conventional under carriage (including wheels and axles).

It is yet another object of this invention to provide a roof structure that can be adapted to fit over an existing roof structure.

Further objects and advantages of the invention will become more apparent in light of the following description of the preferred embodiments.

DESCRIPTION OF THE PREFERRED EMBODIMENT

Figure 1:
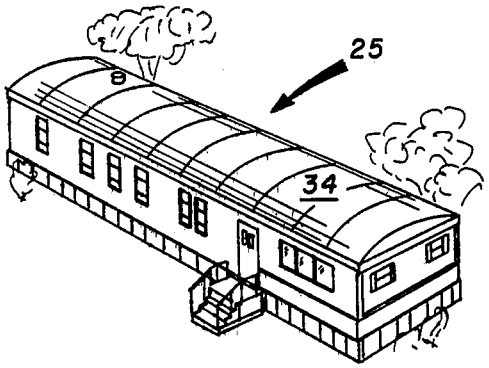
FIG. 1 is a pictorial view of a typical mobile home having an arc-like curved roof configuration.
Figure 2:
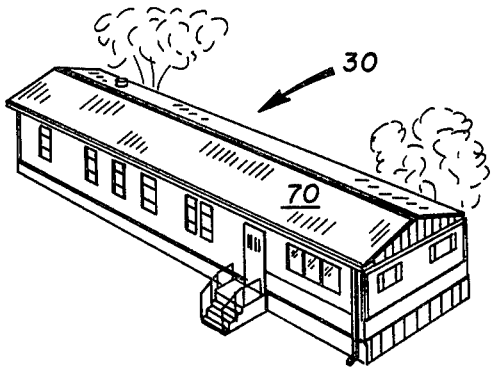
FIG. 2 is a pictorial view of FIG. 1 with a ridge-type roof structure affixed over said arc-like curved roof configuration.
Figure 8:
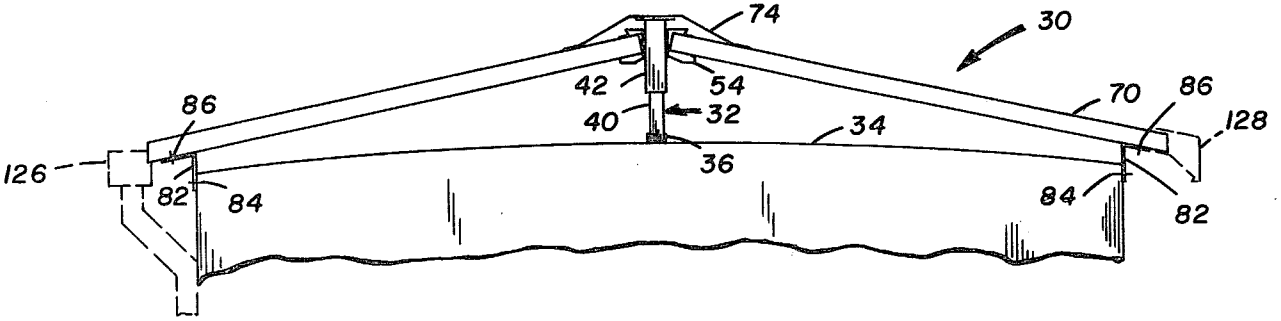
FIG. 8 is a partial cross section of a typical mobile home having an arc-like curved roof configuration, with a ridge-type roof structure affixed thereto.

Referring now to the drawings, and particularly to FIGS. 1 and 2, a typical pictorial view of a mobile home with arc-like curved roof is shown at 25 and a typical pictorial view of a mobile home with a ridge-type roof of this invention superimposed over an arc-like curved roof (the latter not visible) is shown at 30. A typical cross sectional view of the ridge roof 30 is shown in FIG. 8. The arc-like curved roofing 34 of the typical mobile home 25 is shown in FIG. 1; the roofing panels 70, described in detail hereinafter, of the ridge roof 30 are indicated in FIG. 2.

In the description of the ridge roof 30, which is described hereinafter, the structure will be described in a step-by-step manner of fabrication upon a typical arc-like curved roof 25 of a mobile home.

It is to be understood, however, that the ridge roof 30 of this invention may be similarly erected upon a flat-type roof, a roof slanting in a single direction, a multi-level roof, low-pitched ridge-type roofs, or other variations of roofs which it is desired to modify, and such uses are within the scope and intent of this invention.

Figure 3:
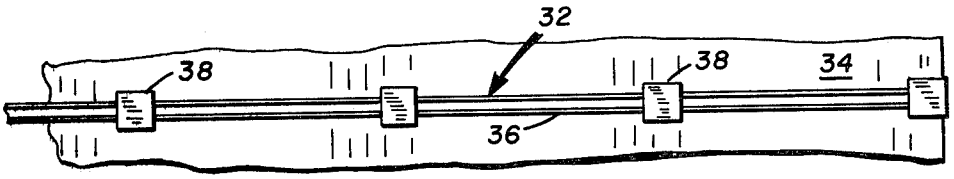
FIG. 3 is a partial top view a central support component for a ridge-type roof structure.
Figure 4:
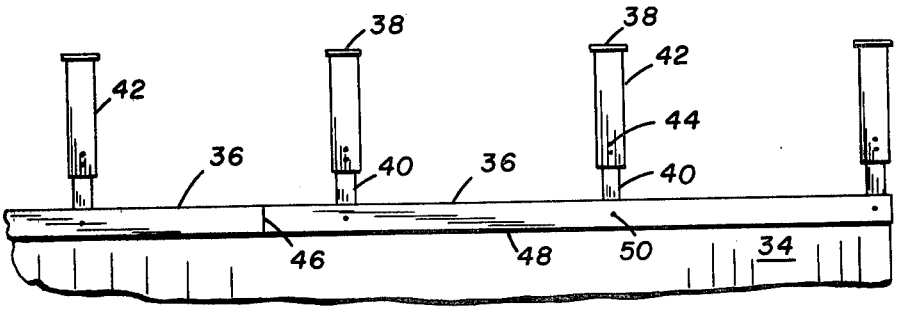
FIG. 4 is a partial side view of FIG. 3.
Figure 5:
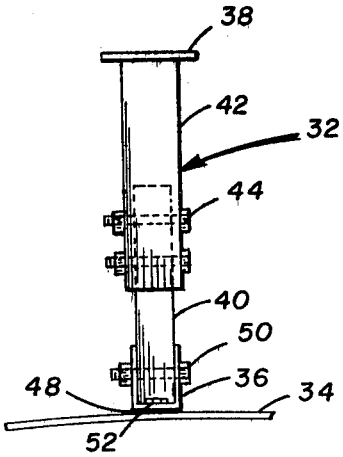
FIG. 5 is an end view of FIG. 4 with channel like member of FIG. 7 omitted.

Turning now to FIGS. 3, 4, and 5, a vertical support component 32 is the main center support for the ridge roof 30. The vertical support component 32 consists of a base channel member 36, a plurality of ridge cap plates 38, a plurality of lower ridge support members 40, a plurality of upper ridge support members 42 and suitable fastening means described hereinafter.

The base channel member 36 is centered and affixed along the longitudinal center line of the arc-like curved roof 25. A sealer means 48 is placed between the undermost web-face of the base channel member 36, when located so that the flanges project vertically upward, and the topmost exterior surface of the arc-like curved roofing 34. A plurality of suitable fastening means 52, such as screws, are inserted through suitable apertures in the web of the base channel member 36 and fastened through the sealer means 48 and into the arc-like curved roofing 34. The base channel member 36 is normally started at the end or edge of the roof of the typical mobile home with arc-like curved roof 25. For extended lengths of such typical mobile homes 25 the base channel member 36 may be in a plurality of sections and abutted 46 to each other.

The lower ridge support member 40 are affixed to the base channel member 36 by suitable fastening means 50, such as bolts, but may be welded or affixed by other suitable means. The lower ridge support members 40 are at spaced intervals along the base channel member 36.

The upper ridge support members 42, one for each lower ridge support members 40, are configured to telescope and slideably fit over the configuration of the lower ridge support members 40. A hollow square configuration is shown for both the lower and upper ridge support members 40 and 42, however, it is to be understood that it is within the scope and intent of this invention to configure these ridge support members in other geometrical patterns.

A ridge cap plate 38 is suitably affixed to each of the uppermost ends of the upper ridge support members 42. The ridge cap plate 38 may be affixed by welding, brazing, bolts and clips, screws and clips, or other suitable means.

The upper ridge support members 42 are suitably affixed to the respective lower ridge support members 40 by suitable means 44 after being slideably and removably placed thereon. The suitable means for affixing 44 may be by a plurality of bolts or screws or other means. Bolts are shown in FIG. 5 passing through suitable mating apertures in both the upper and lower ridge support members 42 and 40 respectively. Each of the upper ridge support members 42 is located on, and then affixed to, its respective lower ridge support member 40 so that the uppermost surface of all of the ridge cap plates 38 are in the same plane and level with each other so as to fix and maintain the level position of the ridge roof 30 structure.

The materials of aforementioned structural elements such as the base channel member 36, lower ridge support members 40, upper ridge support members 42, and ridge cap plate 38, as well as structural elements described hereinafter, such as the special channel for roof panel supports 54, roof panel locking bars 72, soffit support angles 82, air inlet members 88, and valley filler members 100, may be of aluminum, steel, plastics or other suitable material. Aluminum material is preferred because of its light weight and comparitive strength and durability. It is to be understood, however, that variations in the materials is within the scope and intent of this invention.

Figure 6:
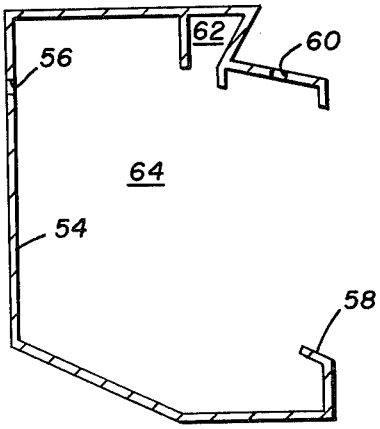
FIG. 6 is a cross sectional view of a central mounting member for roof panels for a ridge-type roof structure.
Figure 7:
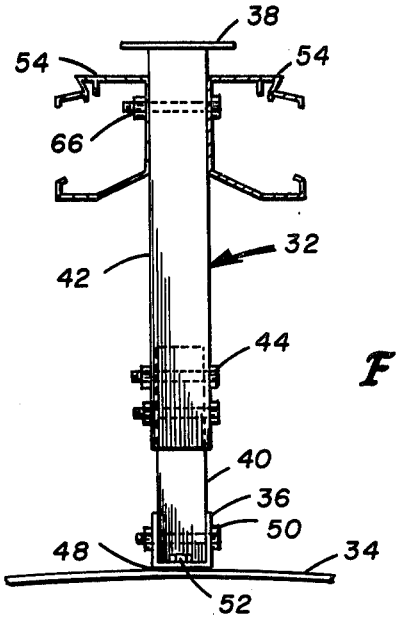
FIG. 7 is the end view of FIG. 5 showing a pair of central mounting members of FIG. 6 affixed thereto.

A pair of special channels 54 for supporting roof panels are suitably affixed 66 to the vertical support component 32 assembly, one special channel 54 on each side of the upper ridge support member 42. The special channels 54 are shown in FIGS. 6 and 7 and are affixed horizontally and aligned parallel with the alignment of the ridge cap plates 38. The special channels 54 normally extend a predetermined distance beyond the end of the mobile home 25 in order to provide an end overhang of the ridge-type roof 30. The special channels 54 may be affixed 66 with bolts, screws, or by other suitable means. A bolt 66 is shown in FIG. 7 passing through suitable apertures 56 in the two special channels 54 and the upper ridge support member 42, one such affixing means 66 at each of the upper ridge support members 42.

Where the length of the mobile home 25 roof is extended, the special channels 54 may be in a plurality of sections and suitably spliced (not shown). Such a splice means may be in the form of a short tube-like configuration to fit between the special channels 54 and suitably affixed to them.

Figure 10:
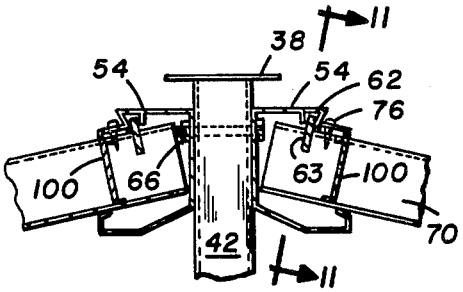
FIG. 10 is an enlarged partial cross section of FIG. 8, showing means for locking roof panels to central mounting member of FIG. 6.
Figure 11:
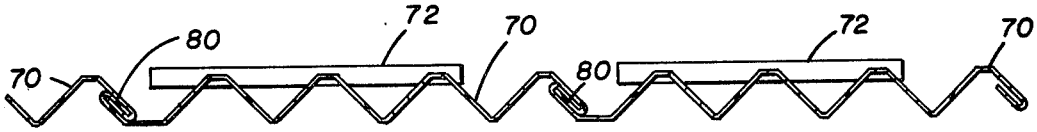
FIG. 11 is a partial cross section of FIG. 10 on line 11—11.
Figure 12:
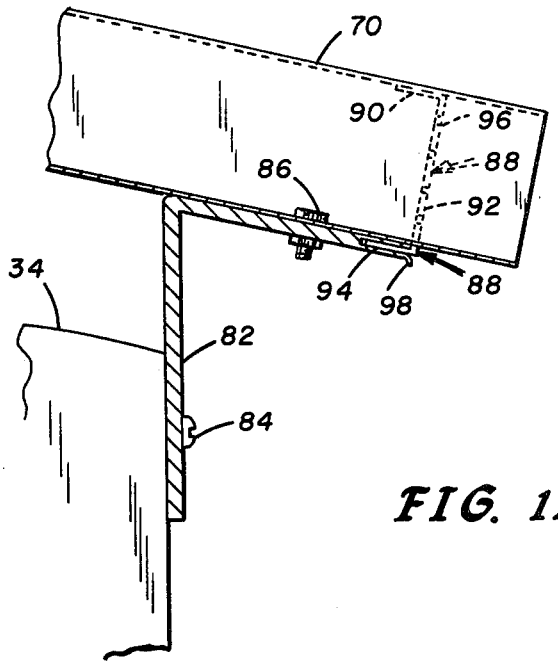
FIG. 12 is an enlarged partial cross section of FIG. 8, showing means of affixing roof panels to eave mounting members.

Turning now to FIGS. 8, 9, 10, 11, 12, and 13, the application of the roofing panels 70 will be described. To begin with, a soffit support angle 82 is suitably affixed such as by a screw 84, to each side, to each side-top, and side- or top of the typical mobile home 25 at the eaves. The soffit support angles 82 normally extend a predetermined distance beyond the end of the mobile home 25 in order to provide an end overhang of the ridge-type roof 30. As shown in FIG. 12, the soffit support angles 82 are affixed to the eaves of the mobile home 25 so as to extend above the arc-like curved roofing 34.

One end of each of the plurality of roof panels 70 of the ridge roof 30 is slideably and removably inserted into the pocket-like interior 64 of the special channels 54, with the other opposite end resting upon the uppermost flange of the soffit support angle 88 as shown in FIGS. 10 and 12. When the uppermost end of each of the roof panels 70 is inserted into the pocket-like interior 64, the lowermost side of the roof panels 70 rests upon support edge 58 of the special channels 54.

To lock the roof panels 70 in place in the pocket-like interior 64, a locking bar 72 is slideably and removably inserted into place with a portion of the locking bar 72 extending upwardly into the locking bar pocket 62 of the special channel 54 (formed by interior projections), and the other portion of the locking bar 72 extending downwardly into the mating locking bar pocket or notch 63 of roof panel 70, as shown in FIG. 10.

Succeeding roof panels 70, installed and locked in place as hereinbefore described, are affixed to each other by slideably and removably connecting them together with the folded seam joint 80 as shown in FIG. 11. The locking bar 72 for each roof panel 70 is also shown in FIG. 11 as being locked to and through a plurality of the adjacent ridge and valley corrugations of the roof panel 70.

At the eave end of the roof panel 70, the roof panels 70 are suitably affixed 86 to the soffit support angle 82 by suitable means, such as by a bolt 86, as shown in FIG. 12, through the valley portion of the roof panel 70.

At the ridge end of the roof panel 70, the roof panels 70 are suitably affixed 76 to the special channels 54 by suitable means, such as by a screw 76, as shown in FIG. 10. The screw 76 passes through the aperture 60 of special channel 54 and into the ridge corrugation of the roof panel 70. Thus, at the ridge end each roof panel 70 is locked in place by locking bar 72 and secured by affixing means 76.

A typical cross section through a ridge roof 30 on a typical single-wide mobile home 25 is shown in FIG. 8, the structure being as described hereinbefore. Note that on a single-wide mobile home 25 a single vertical support component 32 is provided.

Figure 9:
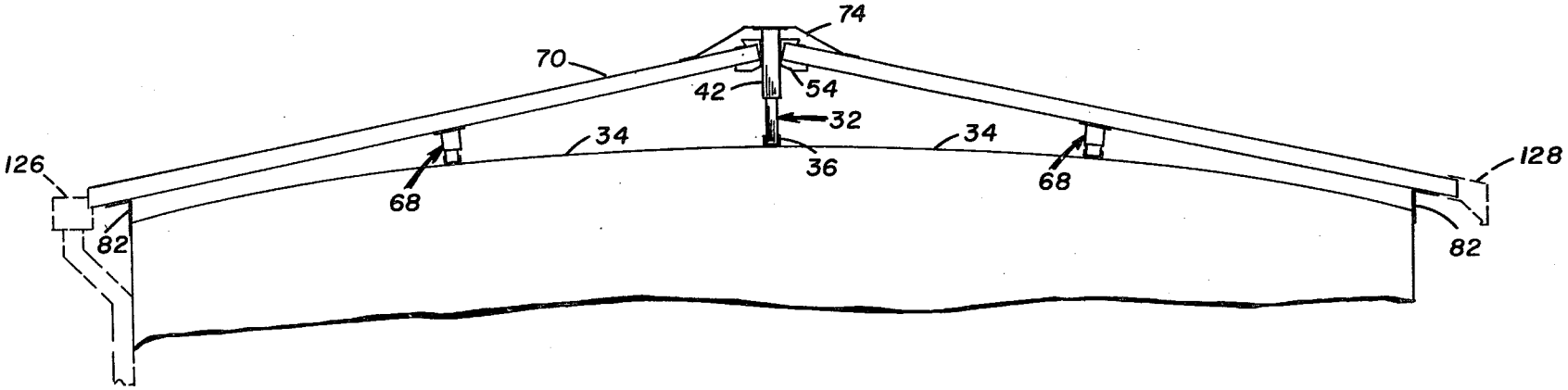
FIG. 9 is a partial cross section of typical double-wide mobile home having an arc-like curved roof configuration with a ridge-type roof structure and intermediate supports affixed thereto.

A typical cross section through a ridge roof 30 on a typical double-wide mobile home 25 is shown in FIG. 9. Note that additional intermediate vertical support means 68 are shown approximately midway between the center vertical support component 32 and the eaves of the double-wide mobile home. The intermediate vertical support means 68 are more or less similar to vertical support means 32 and suitably compensated in configuration to match the slope of the roof panels. A suitable longitudinal support means, not shown, may be included between the topmost ends of the intermediate vertical support means 68.

Figure 13:
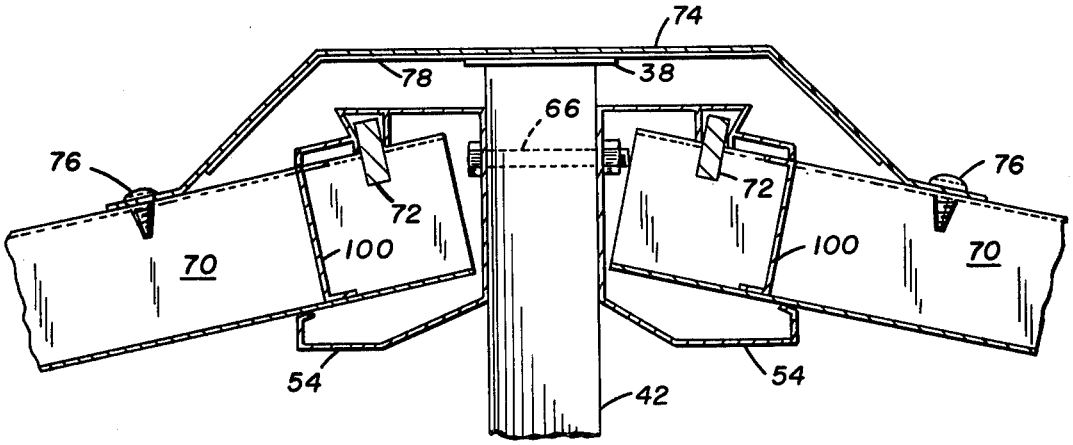
FIG. 13 is an enlarged partial cross section of FIG. 8, showing ridge cap member.
Figure 14:
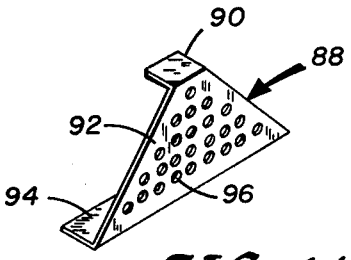
FIG. 14 is a pictorial view soffit inlet member for a ridge-type roof structure.
Figure 15:
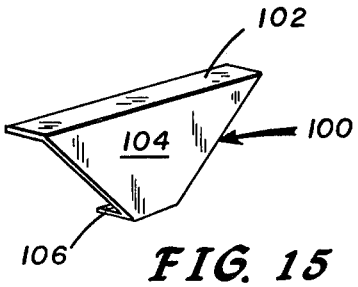
FIG. 15 is a pictorial view of valley filler member for a ridge-type roof structure.

In FIG. 13 the ridge cap 74 is shown affixed 76 over the ridge cap plates 38. The ridge cap 74 extends longitudinally along the entire length of the ridge roof 30 structure. Where the length is extensive, the ridge cap 74 may be spliced by the use of suitable ridge cap splice means 78. The ridge cap 74 is affixed 76 to the ridge corrugations of the roof panels 70 by suitable means, such as by screws 76.

A plurality of air inlet members 88 are removably snapped into place at eave ends of the roof panels 70. The air inlet members 88 consist of a short upper or top flange 90, a long lower or bottom flange 94, and a web 92 connecting the top and bottom flanges 90 and 94, respectively, together. A plurality of air inlet holes or apertures 96 pass through the web 92. In snapping the air inlet members 88 into place, one is placed into each opening between the uppermost of the soffit support angle 82 and the underside of the inverted valley of the roof panel 70. The short top flange 90 fits the contour of the inverted valley of the roof panel 70, the sloping sides of the web 92 fits the contour of the sides of the inverted valley of the roof panel 70, and the long bottom flange 94 slideably and removably snaps into the slot 98 in the outstanding leg of soffit support angle 82. These air inlet members 88 are normally set in place just before the fastening means 86 is installed to facilitate the ease of snapping it in position.

A plurality of valley filler members 100 are snapped or pressed into place as close to the special channel 54 as possible. The individual valley filler members 100 are sealed around the sides and bottom with a suitable sealer. The installation and sealing of the valley filler members 100 is performed before the ridge cap 74 is installed.

The valley filler member 100 is located and fixed in place with the short bottom flange 106 downward to fit in the bottom contour of the valley of the roof panel 70 corrugations. The long top flange 102 fits across the wide top portion of the valley of the roof panel 70 corrugation. The web 104 of the valley filler member 100 thus suitably closes or fills the valley contour of the roof panel 70 corrugation.

An accessory combination rain gutter and downspout (with trim) 126 may be suitably affixed along the eave of the ridge roof 30 as shown in phantom lines in FIG. 8. Likewise, an optional accessory trim 128 may be suitably affixed along an eave of the ridge roof 30, as shown in phantom lines in FIG. 8, if a rain gutter and downspout 126 is not desired or required.

Figure 16:
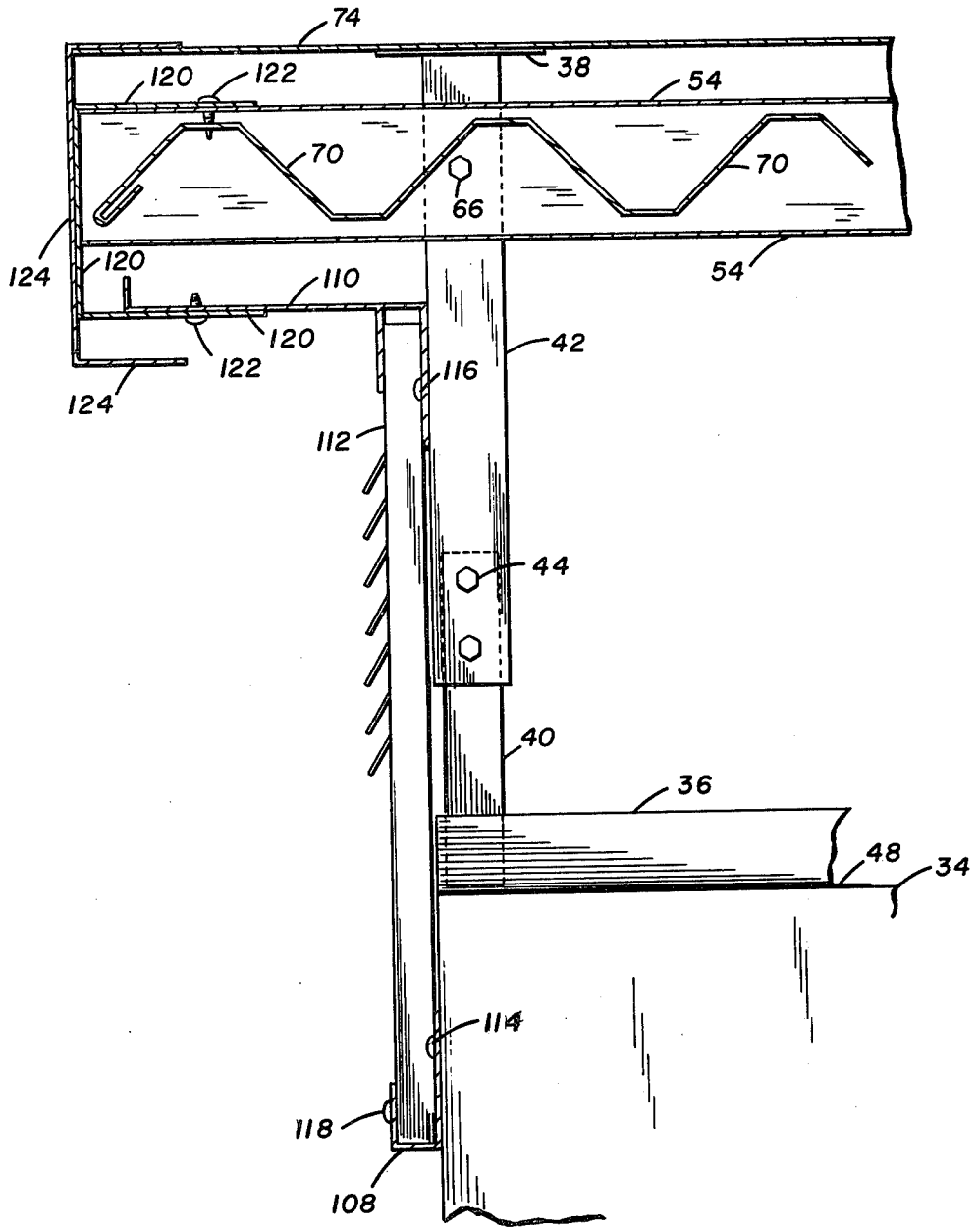
FIG. 16 is a partial cross sectional view of a gable end of a ridge-type roof structure.

At the gable ends the ridge roof 30 is enclosed with a ventilating panel structure as shown in FIG. 16. A lower end panel support means 108 is affixed to the typical mobile home 25 with a suitable fastening means 114, such as a screw. An overhang filler and upper end panel support means 110 is suitably affixed to the typical mobile home 25 with a suitable fastening means 116, such as a screw.

A plurality of vented and solid (or non-vented panels 112 are slideably and removably inserted in the track-like or guide-like retaining configuration of lower and upper end panel support means 108 and 110, respectively, as shown in FIG. 16. The panels 112 are affixed in position by suitable fastening means 118, such as by screws.

An end tie channel member 120 is suitably affixed to the projecting ends of special channels 54 by fastening means 122, such as by screws. The end tie channel member 120 may be extended to follow the slope of the roof panels 70 at the gable end of the ridge roof 30, and suitably fastened thereto. An end cap trim means 124 may be affixed to the end tie channel member 120, and may follow the slope of the roof panels 70 and be suitably affixed thereto.

The telescoping upper and lower ridge supports 42 and 40 respectively may be provided with a greater plurality of apertures spaced apart for fastening means 44 so as to permit a range of choices of heights for the vertical support component 32. With a choice of a range of heights of the vertical support component 32, the slope of the roof panel 70 may be adjusted to a slope of predetermined and desired pitch. The slope is determined by the difference in elevation between the uppermost surface of the soffit support angle 82 and the support edge 58 of the special channel 54.

However, it is to be noted that varying the pitch of the roof panels 70 may require a plurality of choices of soffit support angle 82 or a field modification of the slope of the outstanding leg of the soffit support angle 82 so that there is a neat interface of the uppermost surface of the soffit support angle 82 and the underside of the roof panels 70; also, such a neat interface is necessary so that the bottom flange 94 of an inlet member 88 will fit and conveniently snap into the slot 98 in the outstanding leg of the soffit support angle 82.

At the location of roof stacks or vents that project through the roof panels, flashing is accomplished by extending the flashing back to and under the edge of the ridge cap 74.

Figure 17:
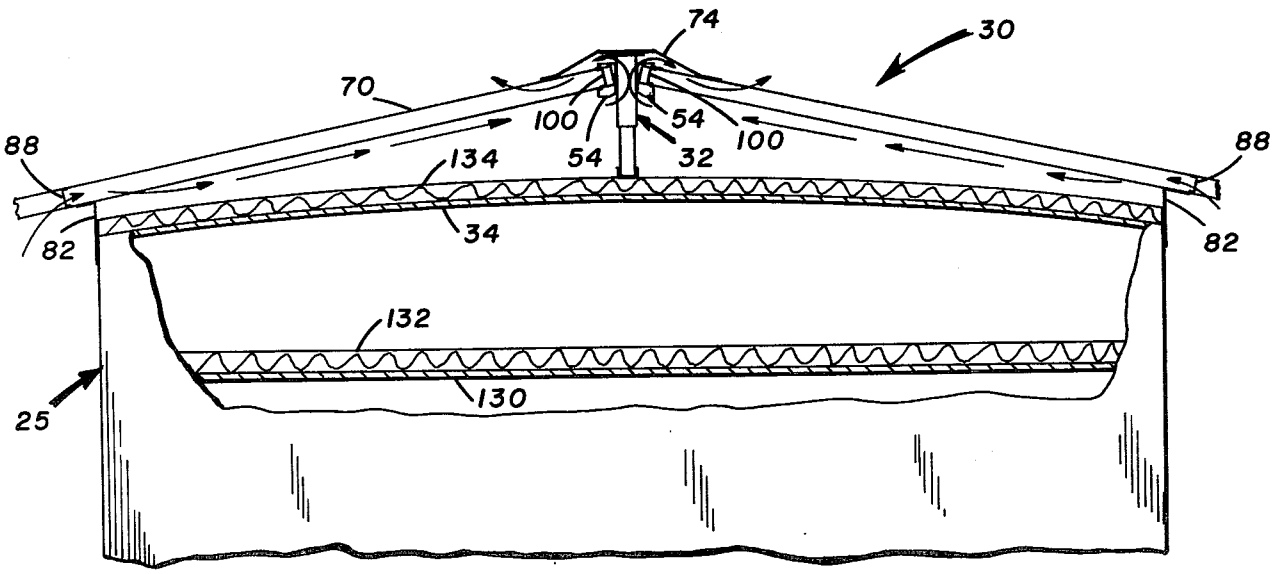
FIG. 17 is schematic cross section of a ridge-type roof structure, showing flow of ventilation through the roof structure.

The structure as described hereinbefore facilitates natural ventilation of the added-on attic formed between the roof panels 70 and the exterior surface of the arc-like curved roofing 34 or other surface over which the ridge roof 30 is installed. Referring to FIG. 17, the path of the ventilation by natural draft movement is shown by the path of the arrows in the schematic cross section through the roof portion of a typical mobile home with arc-like curved roof 34 with a ridge roof 30 superimposed thereon.

Normal insulation 132 in a typical mobile home 25 is shown above the ceiling 130. An optional insulation 134 may be added on the exterior surface of the arc-like curved roofing 34 for added efficiency.

The natural movement of the ventilating air is upward in the downturned valleys of the roof panels 70 and then through apertures 96 in the air inlet members 88 inserted in each of the downturned valleys of the roof panels 70.

After passing through the air inlet members 88 the air is within the "attic" area formed by the ridge roof 30. The natural movement of the air is upward toward the ridge of the roof and passes upward between the two special channels 54 which are affixed to the upper ridge support members 42. Concurrently, the air also passes upward between each pair of adjacent upper ridge support members to which the two special channels 54 are affixed.

Figure 18:
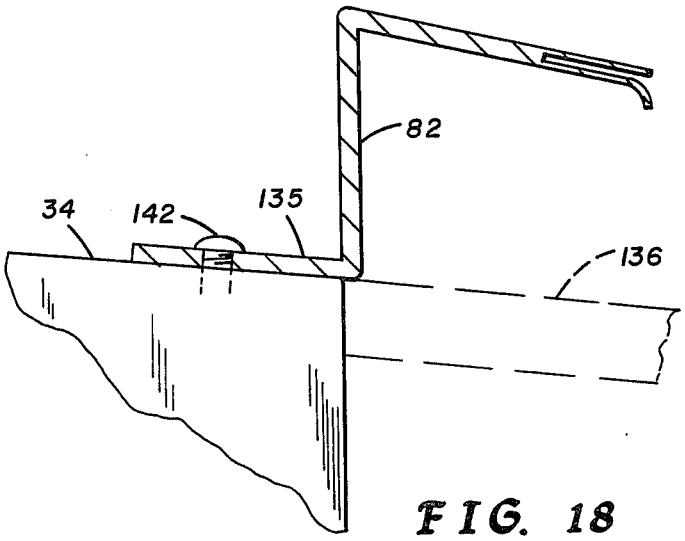
FIG. 18 is an enlarged partial cross section of a second soffit support similar to that shown in FIG. 12 for holding roof panels in position.
Figure 19:
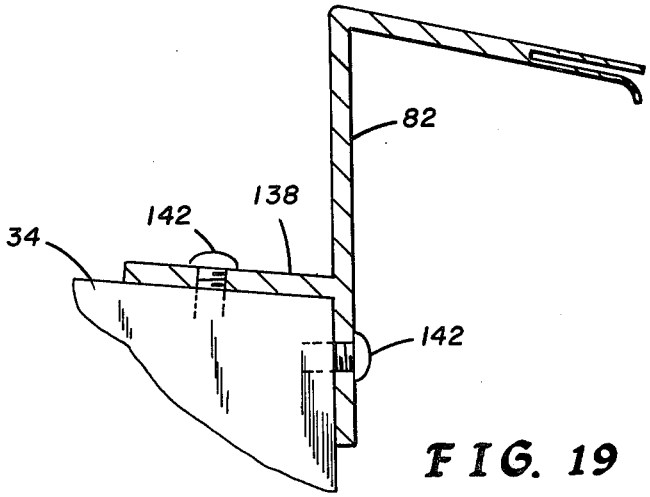
FIG. 19 is an enlarged partial cross section of a third soffit support similar to that shown in FIGS. 12 and 18 for holding roof panels in position.
Figure 20:
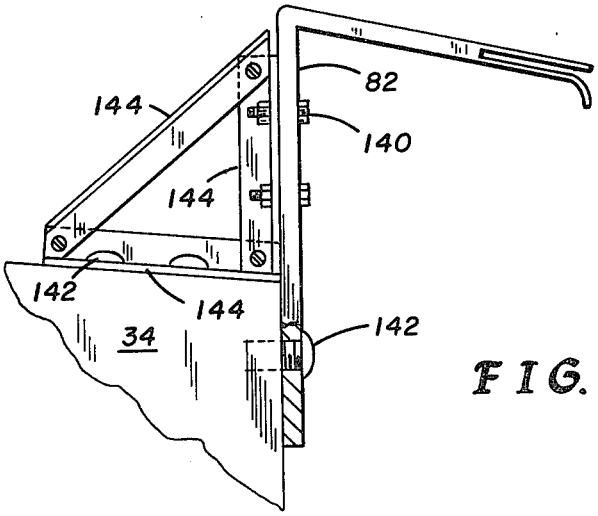
FIG. 20 is an enlarged partial cross section of a third soffit support similar to the ones shown in FIGS. 12, 18, and 19, using a knee brace to support the extended leg.

Several modifications of the invention are shown in FIGS. 18, 19 and 20, taken in conjunction with FIG. 12. In the modification shown in FIG. 18, when a structure is located close to the top of the mobile home, the standard leg 82 of FIG. 12 must be shaped with the flange 135 to mount on the roof 34 with bolts 142 when the mobile home is not structurally sound, a double support 138 secured by bolts 142 is necessary as shown in FIG. 19. In the improvement shown in FIG. 20, when the soffit support is higher than standard, a knee brace 144 secured by bolts 140 and 142 is used to support the extended brace.

The air then curves over under the ridge cap 74 and escapes to atmosphere through the upturned valleys under the distal edges of the ridge cap 74. The roof cap keeps the rain or snow, or hail from entering the roof.

As can be readily understood from the foregoing description of the invention, the present structure can be configured in different modes to provide the facility of a ridge roof with some flexibility of erection and adaptability to cover an outdated, worn-out, or inefficient roof or roof section.

Accordingly, modifications and variations to which the invention is susceptible may be practiced without departing from the scope and intent of the appended claims.

What is claimed is:

1. A roof structure, comprising:

a center support component, said center support component being vertically adjustable to a plurality of heights, said center support component being suitably affixed to a structure requiring a new roof structure;

a first pair of roof panel support members, said roof panel support members being spaced apart and suitable affixed to said center support component, said roof panel support members being longitudinally parallel to said center support component to which affixed, said first pair of roof panel support members being channel-like in configuration;

a second pair of roof panel support members, said second pair of roof panel support members being spaced from said first pair of roof panel support members, said second pair of roof panel support members being spaced apart from each other and being suitably affixed to said structure requiring a roof structure, said second pair of roof panel support members being angle-like in configuration;

a plurality of interlocking roof panels, said plurality of roof panels being of a corrugated configuration, each roof panel of said plurality of roof panels having a first end and a second end, said first end of each said roof panel being slideably and removably inserted into and suitably affixed to one of said first pair of roof panel support members, said second end of each said roof panel being set upon and suitably affixed to one of said second pair of roof panel support members;

a plurality of locking bars, each locking bar of said plurality of locking bars being slideably and removably set so as to lock one of said roof panels to one of said first pair of roof panel support members;

a ridge cap member, said ridge cap member being suitably affixed to said plurality of roof panel members, said ridge cap member being located and affixed to said plurality of roof panel members at said first end thereof where said first end inserts into and is affixed to said first pair of roof panel support members.

2. A roof structure as recited in claim 1, wherein said roof structure is for mounting upon and affixing to a typical mobile home, said mobile home having an arc-like curved roof configuration.

3. A roof structure as recited in claim 1, wherein said center support component consists of:

a base member, said base member being channel-like in configuration;

a plurality of first vertical support members, each first vertical support member of said plurality of first vertical support members being hollow and tubular-like in configuration, said plurality of first vertical support members being spaced apart and each said first vertical support member being suitably affixed to said base member;

a plurality of second vertical support members, each second vertical support member of said plurality of second vertical support members being hollow and tubular-like in configuration, said plurality of second vertical support members being spaced apart and each said second vertical support member being telescopingly slideably and removably assembled over a corresponding and mating said first vertical support member, each said second vertical support member being suitably affixed to a respective mating said first vertical support member, the top uppermost end of each said second vertical support member being maintained in the same horizontal plane when being affixed to its said respective mating first vertical support member;

a plurality of ridge plate members, each ridge plate member of said plurality of ridge plate members being suitably affixed to a respective said top uppermost end of a second vertical support member, thereby causing the top uppermost surface of each said ridge plate to be maintained in the same horizontal plane;

a sealing means, said sealing means being located and placed between said base member and the exterior surface of a roof of said structure requiring a new roof structure, said base member being suitably affixed with a fastening means to said roof of said structure requiring a new roof structure, said fastening means passing through said sealing means.

4. A roof structure as recited in claim 1, wherein each said first roof panel support member, being configured in a channel-like manner, contains a general pocket area for said first end of said roof panels, and additionally, a plurality of projections interiorly to form an interior pocket-like area, said interior pocket-like area receiving a first portion of said locking bars when slideably and removably set to lock said roof panels to said roof panel support member, and additionally, a portion of one flange of each said channel-like first roof panel support member is bent inwardly to form a support edge for said roof panels.

5. A roof structure as recited in claim 1, wherein each said second roof panel support member, being configured in an angle-like manner, additionally, one leg of said angle-like configuration is partially bifurcated so as to form a slot along its entire lineal length.

6. A roof structure as recited in claim 1, wherein said roof panels are cross sectionally configured into a plurality of corrugations having flat apexes to form alternate upturned and downturned valleys, and additionally, a folded lap along each longitudinal side at the last corrugation, said folded laps providing a means for slidably and removably connecting adjacent roof panels to each other, and additionally, a transverse notch spaced from said first end of said roof panel cut partially into upstanding corrugations, said notch receiving a second portion of said locking when slidably and removably set to lock said roof panels to said roof panel support member, and additionally, each said roof panel being further affixed to said roof panel support member by a fastening means.

7. A roof structure as recited in claim 1, wherein said locking bars are each of rectangular cross section and of a length to lock one roof panel to a channel like member.

8. A roof structure as recited in claim 3, wherein said ridge cap member is formed into an inverted V-like configuration with flanged ends, said ridge cap member being supported by said plurality of ridge plate members, the flanged ends being suitably affixed to said roof panels.

9. A roof structure as recited in claim 5, and additionally, a plurality of air inlet members, each said air inlet member of said plurality of air inlet members being of channel-like cross-sectional configuration, said air inlet members having a plurality of air inlet apertures in the web thereof, each said air inlet member being slideably and removably inserted into the eave end of a downward turned valley of one of said corrugated configurations of said roof panel members, said air inlet member being further configured to the interior configuration of said downward turned valley, the lower flange of said air inlet member being slideably and removably inserted in said slot of said second roof panel support member.

10. A roof structure as recited in claim 4, and additionally, a plurality of valley filler members, each said valley filler member of said plurality of air inlet members being of channel-like cross-section configuration, said channel-like valley filler members each being further configured to the interior configuration of an upward turned valley of said corrugations of said roof panels, each said valley filler member being slideably and removably inserted into an upward turned valley of said roof panels and located in close proximity to said first roof panel support members, and additionally, each said valley filler member being held in place by a sealing means at the interfacing surfaces with said corrugations of said roof panel members.

11. A roof structure as recited in claim 9, wherein the natural flow of air circulation with said roof structure is inward through said apertures of said air inlet members, upwardly under said roof panel members, further upwardly between said pair of first roof panel support members, and concurrently through said center support component to which said pair of first roof panel support members are affixed, then curvingly under said roof cap member and escaping to atmosphere from under said roof cap member through upwardly turned corrugations of said roof panels.

12. A roof structure as recited in claim 1, wherein structural elements of said roof structure are of aluminum material for light weight, rigidity, and strength, specifically the structural elements comprising said center support component, said pair of first roof panel support members, said pair of second roof panel support members, said plurality of roof panels, said plurality of locking bars, and said ridge cap member, and additionally a plurality of air inlet members and valley filler members, both of aluminum material.

* * * * *